US010099496B2

(12) United States Patent
Quintero Ruiz et al.

(10) Patent No.: US 10,099,496 B2
(45) Date of Patent: Oct. 16, 2018

(54) INHIBITING AIR FLOW

(71) Applicant: HEWLETT-PACKARD DEVELOPMENT COMPANY, L.P., Houston, TX (US)

(72) Inventors: Xavier Quintero Ruiz, Barcelona (ES); Luis Garcia-Maurino Simon, Barcelona (ES); Carmen Blasco Cortes, Sant Cugat del Valles (ES); Mireia Garcia Ferrer, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/307,453

(22) PCT Filed: Jun. 25, 2014

(86) PCT No.: PCT/US2014/044037
§ 371 (c)(1),
(2) Date: Oct. 28, 2016

(87) PCT Pub. No.: WO2015/199673
PCT Pub. Date: Dec. 30, 2015

(65) Prior Publication Data

US 2017/0057264 A1 Mar. 2, 2017

(51) Int. Cl.

| | |
|---|---|
| ***B41J 29/377*** | (2006.01) |
| ***B41J 19/14*** | (2006.01) |
| ***B41J 2/01*** | (2006.01) |
| ***B41J 25/00*** | (2006.01) |

(52) U.S. Cl.
CPC ..... *B41J 29/377* (2013.01); *B41J 2/01* (2013.01); *B41J 19/142* (2013.01); *B41J 19/145* (2013.01); *B41J 25/001* (2013.01)

(58) Field of Classification Search
CPC ..... B41J 29/377; B41J 19/142; B41J 19/145
See application file for complete search history.

(56) References Cited

U.S. PATENT DOCUMENTS

| | | | | |
|---|---|---|---|---|
| 5,519,420 | A | 5/1996 | Zorn et al. | |
| 6,375,304 | B1 | 4/2002 | Aldrich et al. | |
| 6,997,538 | B1 | 2/2006 | Kawamura et al. | |
| 7,044,582 | B2 | 5/2006 | Fredrickson et al. | |
| 7,594,712 | B2 | 9/2009 | Hasegawa | |
| 7,600,852 | B2 | 10/2009 | Brown et al. | |
| 8,562,106 | B2 | 10/2013 | Sakata et al. | |
| 2002/0089563 | A1 | 7/2002 | Tanaka | |
| 2003/0197752 | A1* | 10/2003 | McEltresh | B41J 2/025 347/21 |
| 2009/0002468 | A1* | 1/2009 | Ito | B41J 2/19 347/92 |
| 2013/0068045 | A1 | 3/2013 | Masters et al. | |
| 2013/0100204 | A1* | 4/2013 | Norasak | B41J 29/377 347/37 |

FOREIGN PATENT DOCUMENTS

| | | |
|---|---|---|
| JP | 2011245732 | 12/2011 |

* cited by examiner

*Primary Examiner* — Jason Uhlenhake
(74) *Attorney, Agent, or Firm* — HP Inc. Patent Department

(57) ABSTRACT

In one example, a carriage to carry a printhead back and forth over a print substrate includes an inboard part to hold the printhead and an outboard part to inhibit the flow of air under the carriage when the carriage is moving back and forth over the print substrate.

14 Claims, 11 Drawing Sheets

INHIBITING AIR FLOW

BACKGROUND

Inkjet printers utilize printheads that include tiny nozzles through which ink is dispensed on to paper or another print substrate. In a "scanning" type inkjet printer, the printheads are carried on a carriage that is scanned back and forth over the print substrate as the printheads dispense printing fluid through the nozzles on to the substrate.

DRAWINGS

Figure 19:
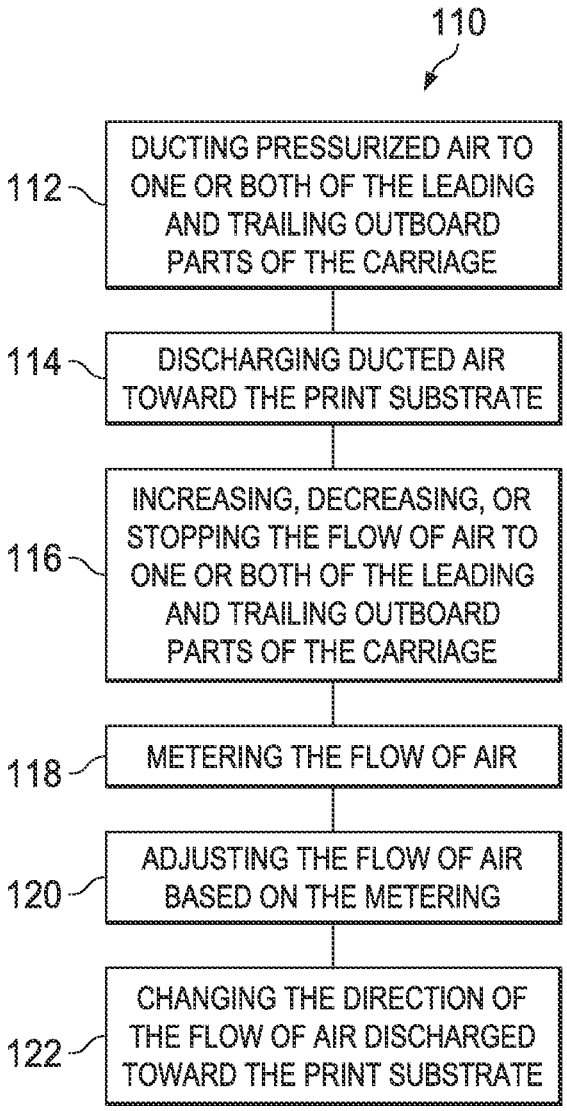

FIG. 19 a flow diagram illustrating one example of a method to actively form an air curtain to inhibit the flow of air through a print zone between a print substrate and printheads on a carriage moving over the substrate.

The same part numbers are sometimes used to designate the same or similar parts throughout the figures.

DESCRIPTION

For scanning type inkjet printers, the combination of higher carriage speeds and closer printhead-to-substrate spacing can cause significant air flow through the print zone under the carriage during printing. Significant air flow under the carriage may adversely affect the placement of the tiny drops of ink or other printing fluid dispensed from the printheads on to the print substrate, resulting in lower print quality and menacing the use of higher carriage speeds and smaller ink drops.

A new carriage has been developed to form a curtain of air across the front of the print zone to inhibit the flow of air under the carriage when the carriage is moving back and forth over the print substrate. In one example, the air curtain is formed actively by ducting pressurized air down toward the substrate at the upstream part of the carriage. In another example, the air curtain is formed passively by redirecting oncoming air at the upstream part of the carriage down toward the substrate.

The examples shown in the figures and described in this Description illustrate but do not limit the invention.

As used in this document, a "printhead" means that part of an inkjet printer or other inkjet type dispenser that dispenses fluid from nozzles or other openings, for example as drops or streams. A "printhead" is not limited to printing with ink but also includes inkjet type dispensing of other fluid and/or for uses other than printing.

Figure 1:
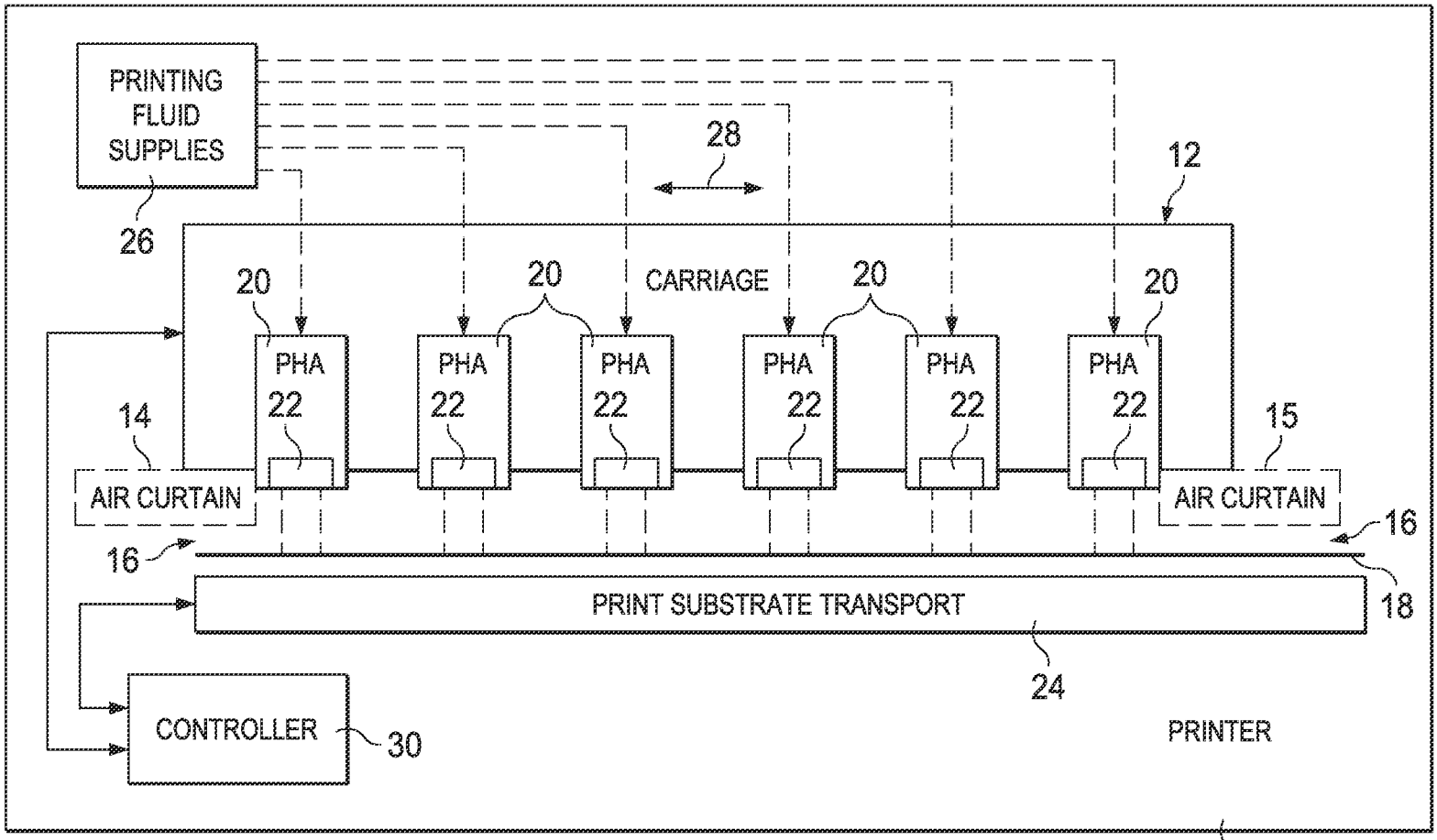
FIG. 1 is a block diagram illustrating a scanning type inkjet printer implementing one example of an air curtain to inhibit the flow of air through the print zone under the carriage.

FIG. 1 is a block diagram illustrating an inkjet printer 10 implementing one example of a carriage 12 that forms an air curtain 14 across the print zone 16 to inhibit the flow of air under carriage 12 when carriage 12 is moving back and forth over a print substrate 18. FIGS. 2-14 illustrate examples of a carriage 12 such as might be used in printer 10 shown in FIG. 1. Referring first to FIG. 1, printer 10 includes carriage 12 carrying printhead assemblies (PHA) 20 each with one or multiple printheads 22. A printhead assembly 20 is also commonly referred to as a pen or print cartridge or ink cartridge. A transport mechanism 24 advances a paper or other print substrate 18 past carriage 12 and printhead assembles 20. Printhead assemblies 20 are operatively connected to ink or other printing fluid supplies 26. Although remote supplies 26 are shown, the printing fluid supplies 26 could be located on carriage 12, for example—with each printhead assembly 20 having an internal supply of printing fluid.

As described in more detail below, carriage 12 is configured to form an air curtain 14, 15 across the front of the print zone 16 at the upstream, leading part of carriage 12 during printing. A "print zone" as used in this document means the region under the carriage during printing. Print zone 16 in FIG. 1, therefore, moves with carriage 12. Direction arrow 28 in FIG. 1 indicates the movement of carriage 12 back and forth over print substrate 18. Each end of carriage 12 will be the upstream, leading part of carriage 12 at any given time during printing, depending on the direction carriage 12 is moving. Thus, an air curtain 14, 15 is shown on each end of carriage 12. Each air curtain 14, 15 may be formed actively, as in the examples shown in FIGS. 2-3, 6-8, and 12-13, or passively, as in the examples shown in FIGS. 4-5, 9-10 and 13-14. Also, an air curtain 14, 15 may be formed only at the upstream part of carriage 12 or simultaneously at both the upstream and downstream parts of carriage 12.

A controller 30 is operatively connected to carriage 12, printhead assemblies 20 and substrate transport 24. Controller 30 represents the program instructions, processor and associated memory, and the electronic circuitry and components needed to control the operative elements of printer 10. Controller 30 is electrically connected to each printhead 22 to selectively energize fluid dispensing elements for dispensing printing fluid on to substrate 18. By coordinating the relative position of carriage 12 and substrate 18 with dispensing printing fluid from printheads 22, controller 30 controls printing the desired image on substrate 18.

Figure 2:
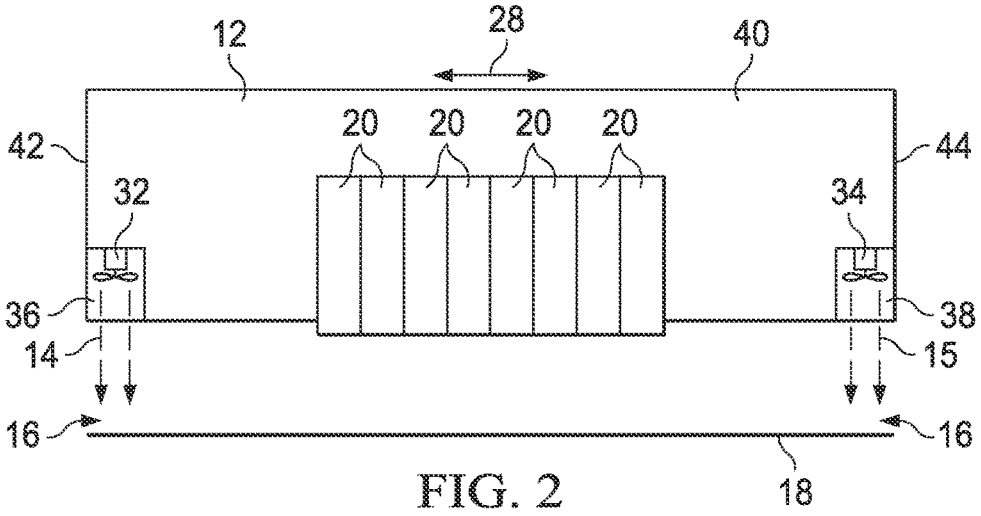
FIGS. 2 and 3 illustrate one example of a carriage configured to actively form air curtains to inhibit the flow of air through the print zone.
Figure 3:
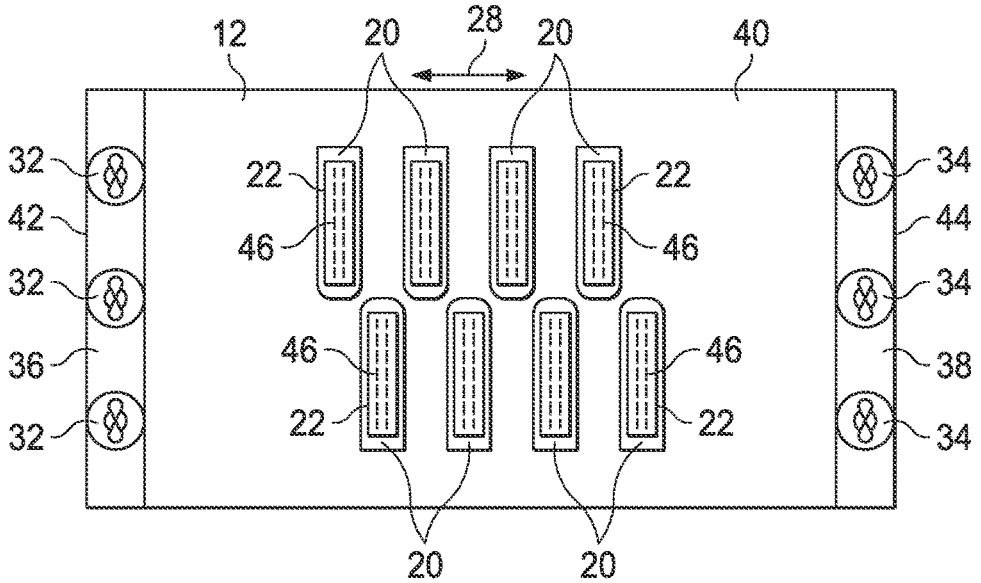

FIGS. 2 and 3 are side elevation and bottom plan views of a carriage 12 that includes fans 32, 34 and ducts 36, 38 to actively form air curtains 14, 15. Referring to FIGS. 2 and 3, carriage 12 includes an inboard part 40 that holds printhead assemblies 20 and outboard parts 42, 44 with fans 32, 34 and ducts 36, 38, respectively. Each printhead assembly 20 includes a printhead 22 with fluid dispensing nozzles 46. When carriage 12 is moving to the left in FIGS. 2 and 3, outboard part 42 is the upstream, leading part of carriage 12 and outboard part 44 is the downstream, trailing part of carriage 12. When carriage 12 is moving to the right in FIGS. 2 and 3, outboard part 44 is the upstream, leading part of carriage 12 and outboard part 42 is the downstream, trailing part of carriage 12.

When carriage 12 is moving to the left in FIGS. 2 and 3, fans 32 are operated to discharge air through duct 36 to form air curtain 14 across print zone 16 along outboard, upstream part 42. If desired, fans 34 may also be operated when carriage 12 is moving to the left to discharge air through duct 38 to form air curtain 15 along outboard, downstream part 44. When carriage 12 is moving to the right in FIGS. 2 and 3, fans 34 are operated to discharge air through duct 38 to form air curtain 15 across print zone 16 along outboard, upstream part 44. If desired, fans 32 may also be operated when carriage 12 is moving to the right to discharge air through duct 36 to form air curtain 14 along outboard, downstream part 42.

Although three fans 32, 34 positioned in each part 42, 44 are shown, other suitable configurations are possible. For example, more or fewer fans may be used. For another example, the fan or fans could be located remote from parts 42, 44 or ducts 36, 38 (on or off carriage 12) and the pressurized air ducted to parts 42, 44 or ducts 36, 38. Each group of multiple fans 32, 34 may be operable together (and not individually) or each fan 32, 34 may be operable individually for greater control of the overall flow from each duct 36, 38. Variable speed fans 32, 34 could also be used for more flow control. Also, while a single duct 36, 38 is shown on each outboard part 42, 44, more or fewer ducts could be used. For example, a separate duct for each fan could be used.

Figure 4:
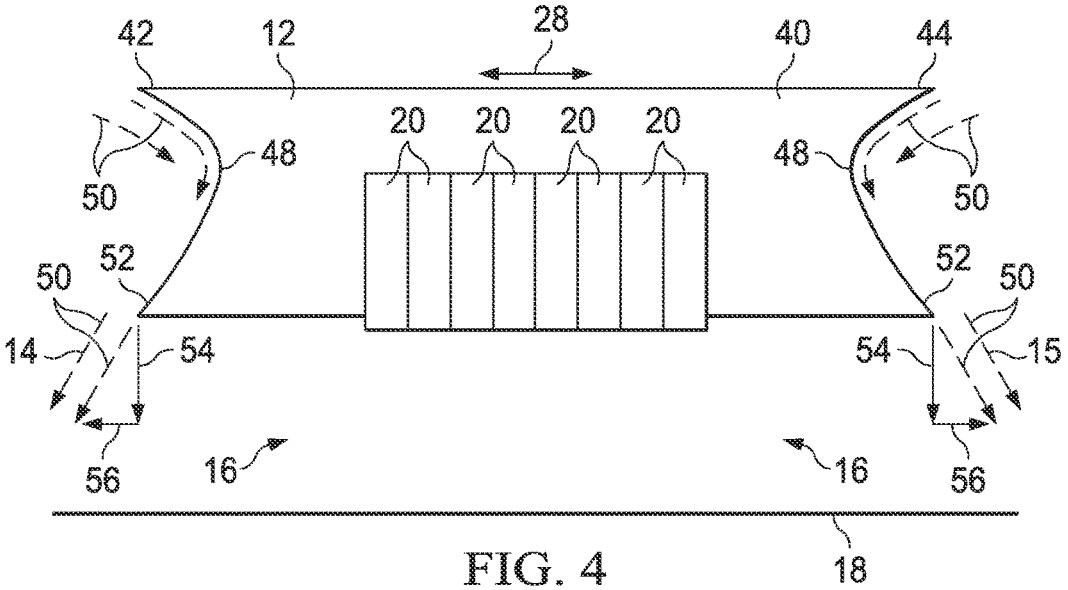
FIGS. 4 and 5 illustrate one example of a carriage configured to passively form air curtains to inhibit the flow of air through the print zone.
Figure 5:
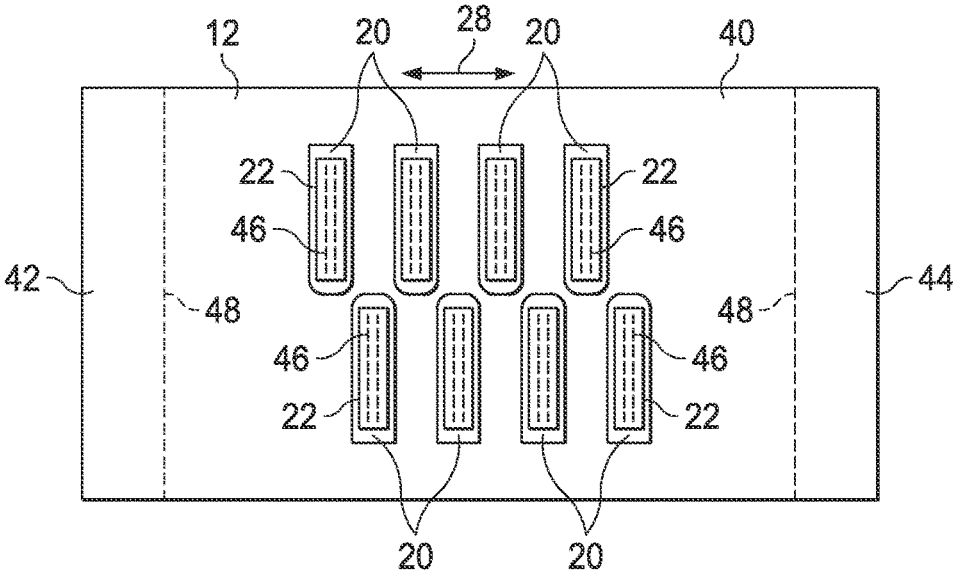

In the example shown in FIGS. 4 and 5, each outboard part 42, 44 of carriage 12 is shaped to redirect oncoming air down toward print substrate 18 to passively form air curtains 14, 15. Referring to FIGS. 4 and 5, each outboard part 42, 44 forms an air scoop 48 to channel oncoming air downwards to form air curtains 14, 15, as indicated by flow arrows 50 in FIG. 4. In this example, the trailing part 52 of scoop 48 is angled down and out to produce an air curtain 14, 15 with an air flow component 54 down across print zone 16 toward print substrate 18 (orthogonal to the direction the carriage moves) and an air flow component 56 upstream away from the carriage (parallel to the direction the carriage moves). An angled curtain 14, 15 such as that shown in FIG. 4 may be desirable in some printer configurations to more effectively block the flow of air under carriage 12, for example in configurations with closer printhead to substrate spacing or configurations that yield lower air curtain flows.

Figure 6:
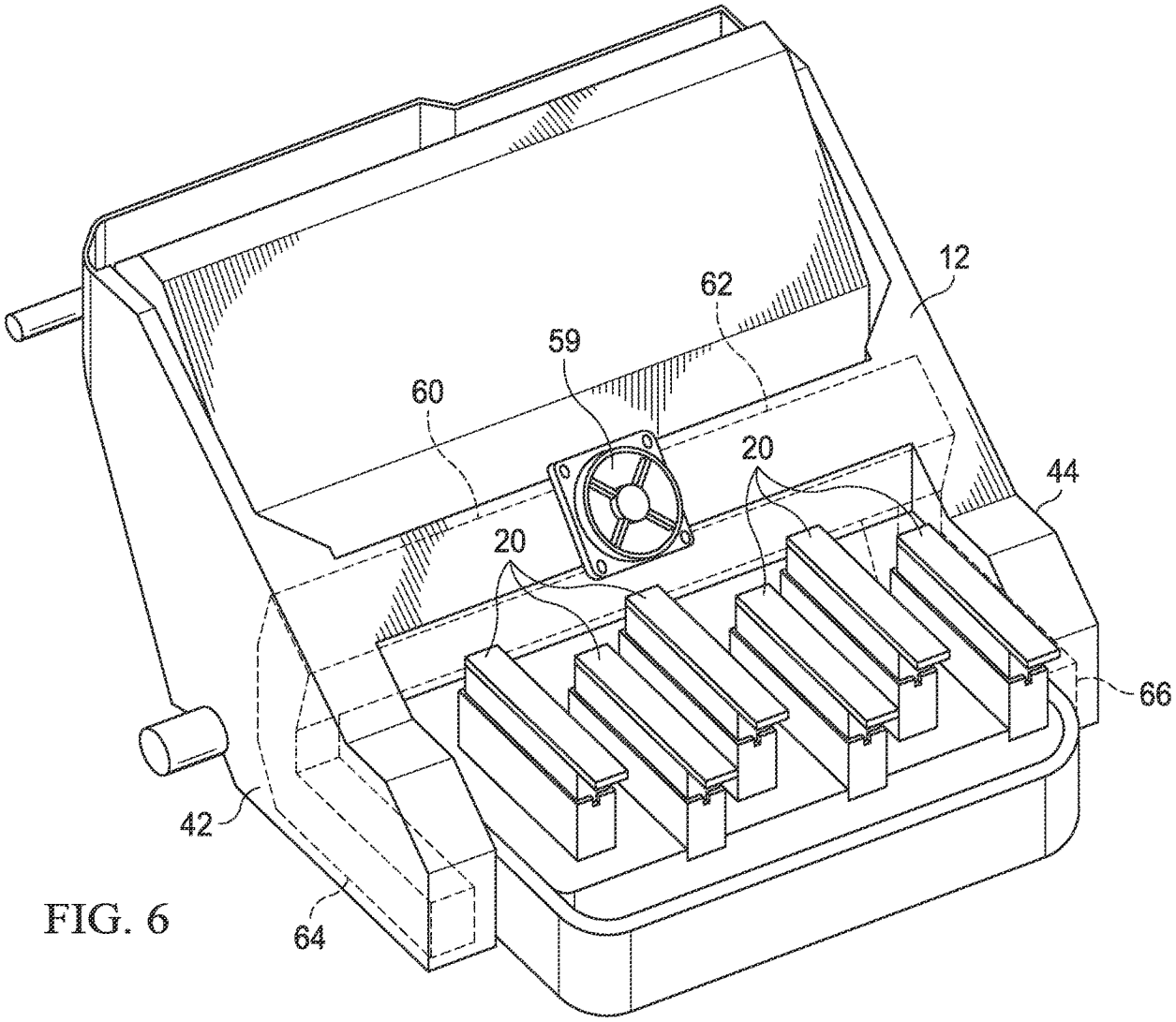
FIGS. 6-8 illustrate another example of a carriage configured to actively form air curtains to inhibit the flow of air through the print zone.
Figure 7:
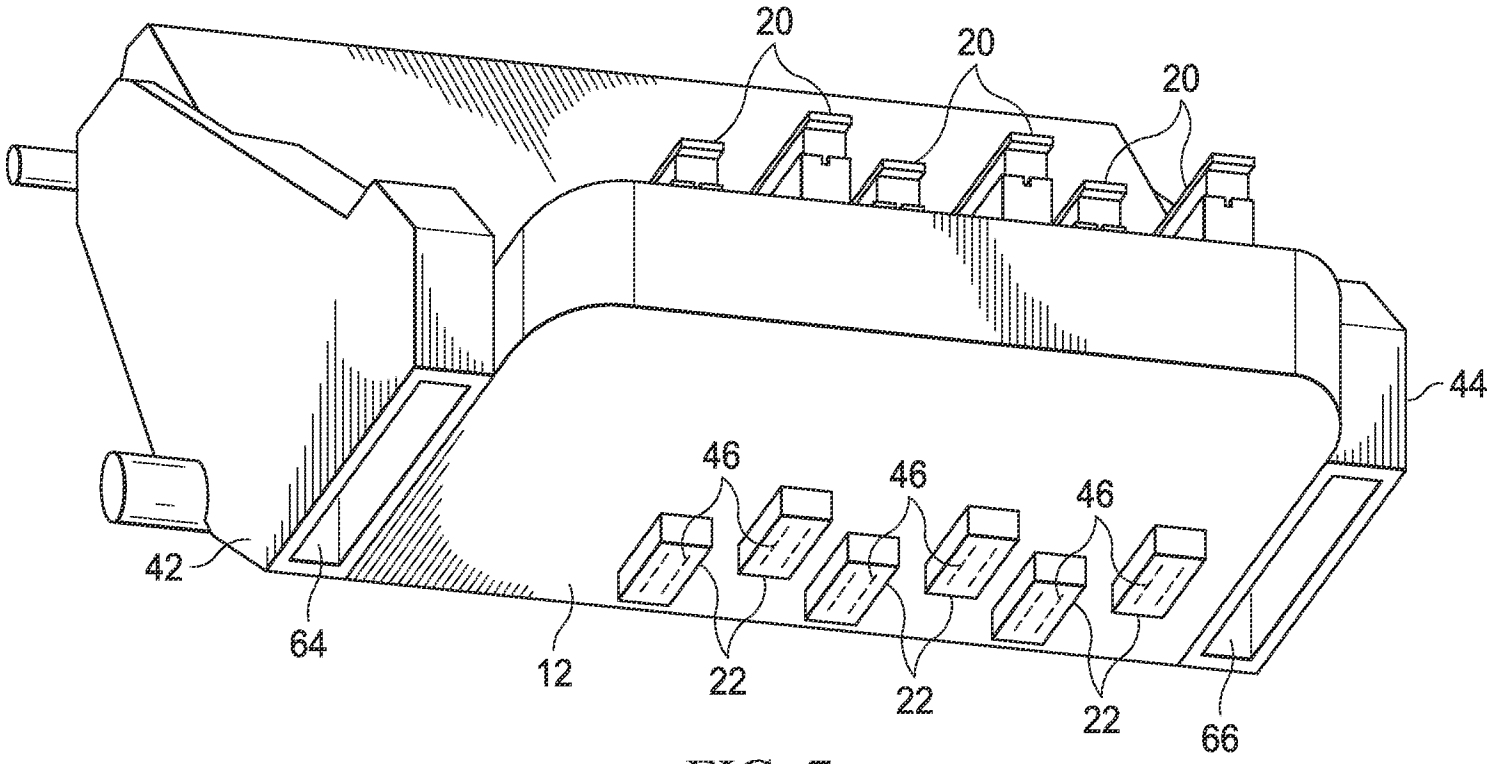
Figure 8:
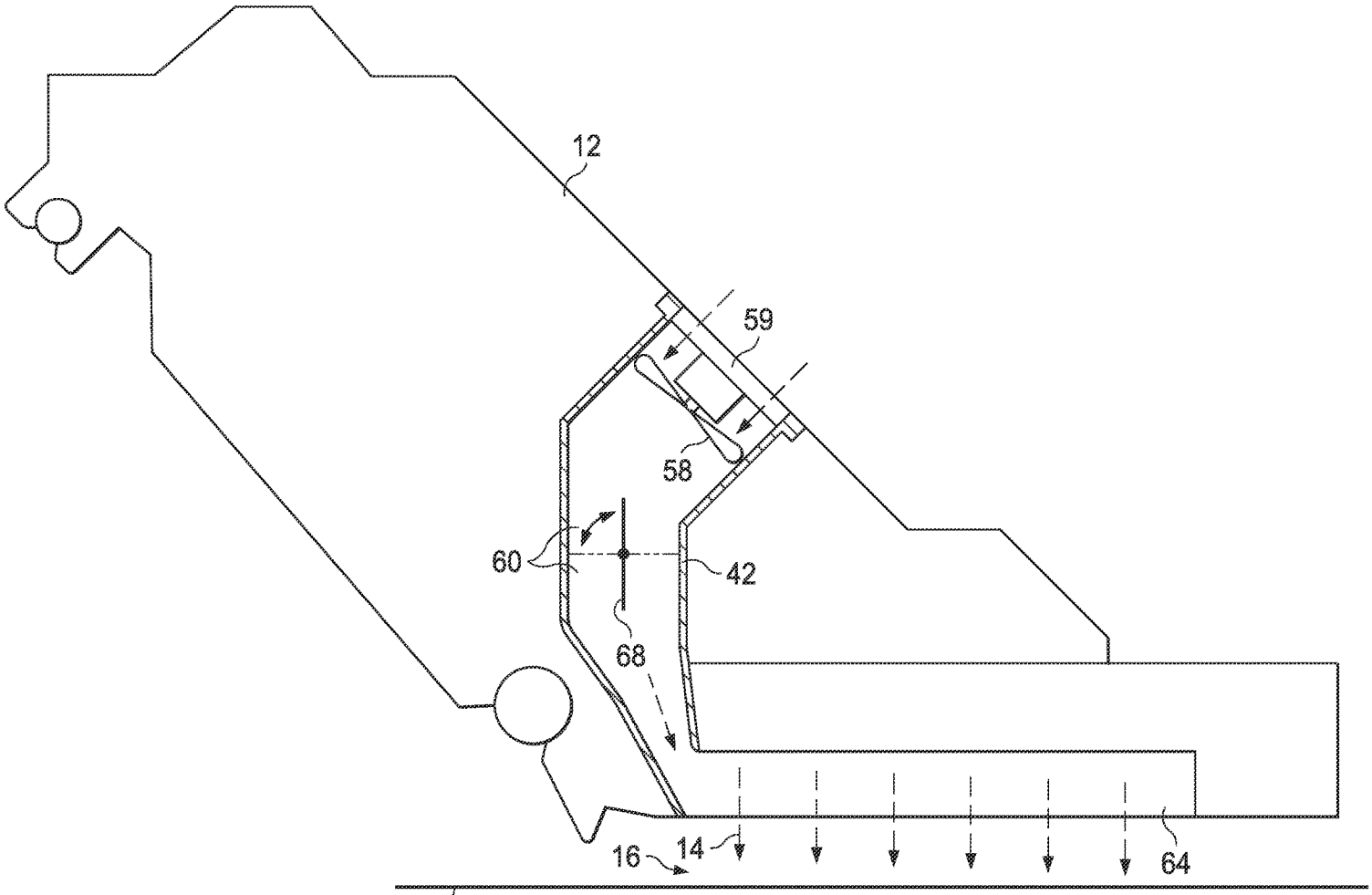

FIGS. 6-8 illustrate another example of an inkjet printer carriage 12, in which the air curtains are formed using a single fan 58 (FIG. 8). Referring to FIGS. 6-8, fan 58 draws air through an intake 59 and forces air through lateral ducts 60, 62 to discharge ducts 64, 66 at each outboard part 42, 44, respectively, to actively form air curtains 14, 15 (FIG. 8). (Only air curtain 14 is visible in FIG. 8.) When carriage 12 is moving to the left and to the right in FIGS. 6 and 7, fan 58 blows through ducts 60/64 and 62/66 to simultaneously form both air curtains 14 and 15. Thus, in this example, an air curtain 14, 15 is formed at the leading, upstream part of carriage 12 and at the trailing, downstream part of carriage 12. In other examples, a damper 68 (FIG. 8) may be used inside each ducts 60, 62 to close off the air flow to the trailing, downstream part of the carriage to generate only a leading, upstream air curtain. It may even be desirable in some implementations to generate only a trailing, downstream air curtain.

Figure 10:
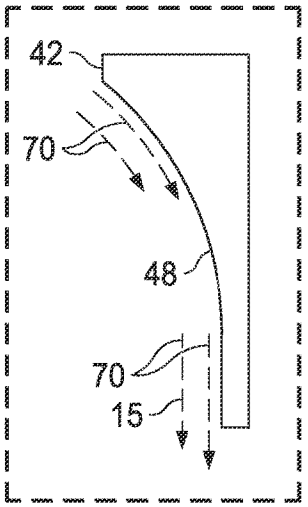
FIGS. 9-10 and 11-12 illustrate other examples of a carriage configured to passively form air curtains to inhibit the flow of air through the print zone.
Figure 9:
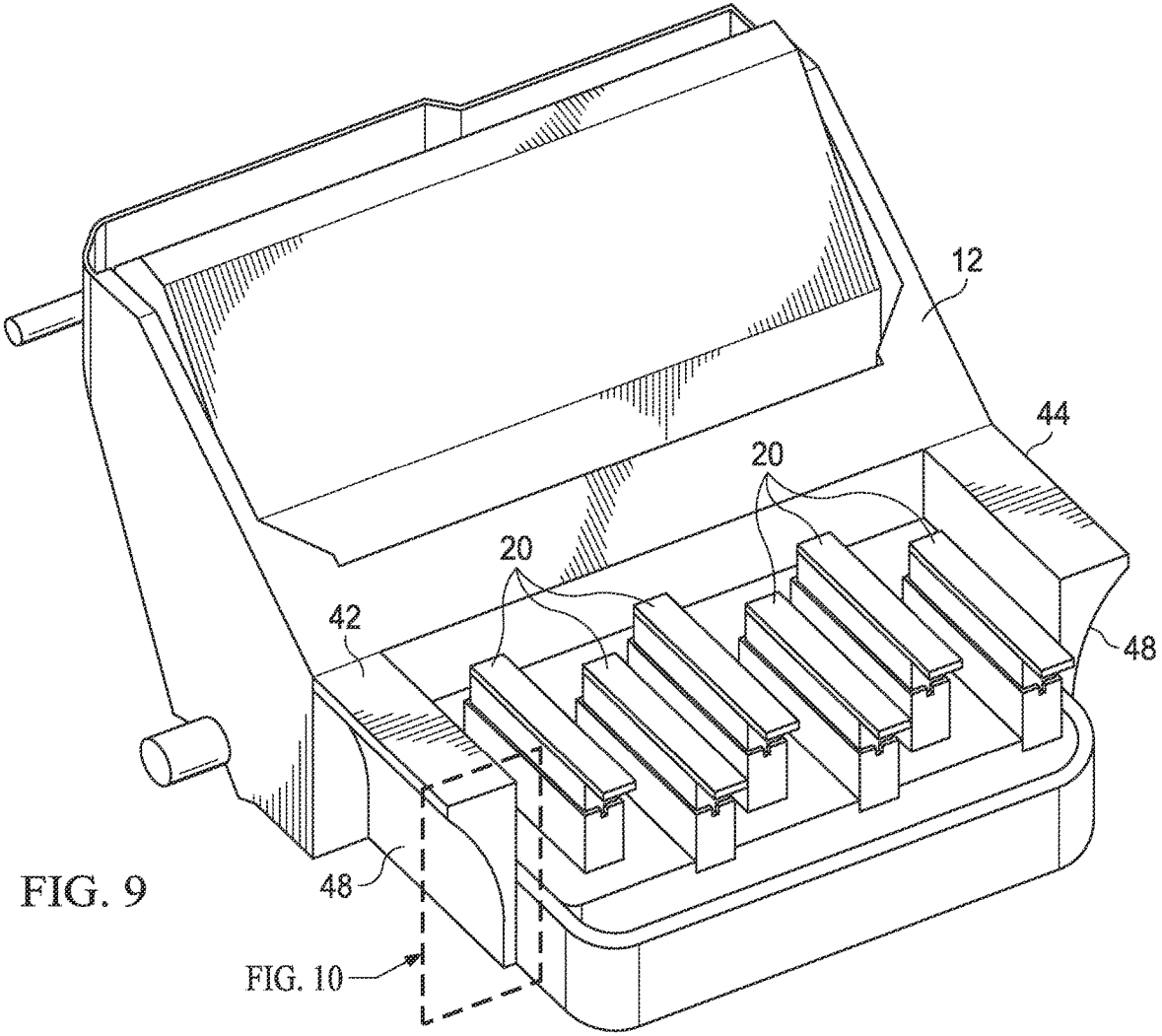

FIGS. 9 and 10 illustrate another example of an inkjet printer carriage 12, in which the air curtains are formed with scoops 48 at each outboard part 42, 44 of carriage 12. Referring to FIGS. 9 and 10, in this example each scoop 48 is shaped to collect oncoming air and redirect the air straight downwards toward the print substrate to form vertical air curtains 14, 15, as indicated by flow arrows 70 in FIG. 10.

Figure 11:
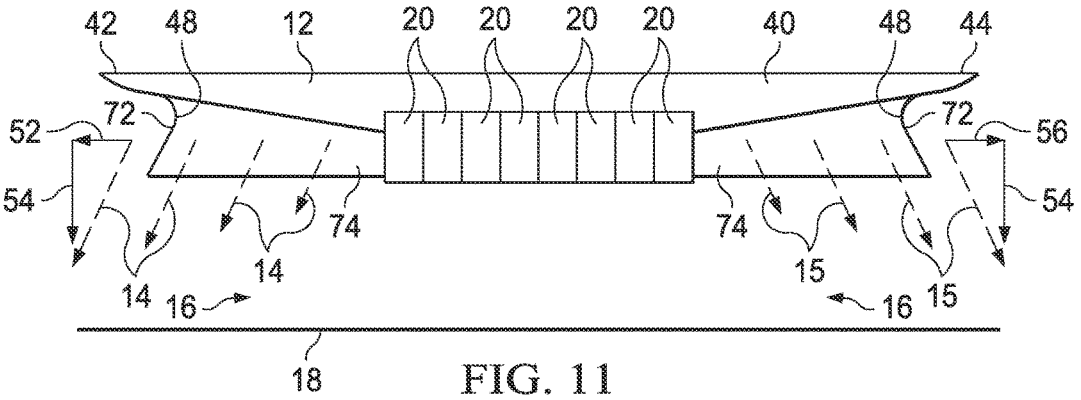
Figure 12:
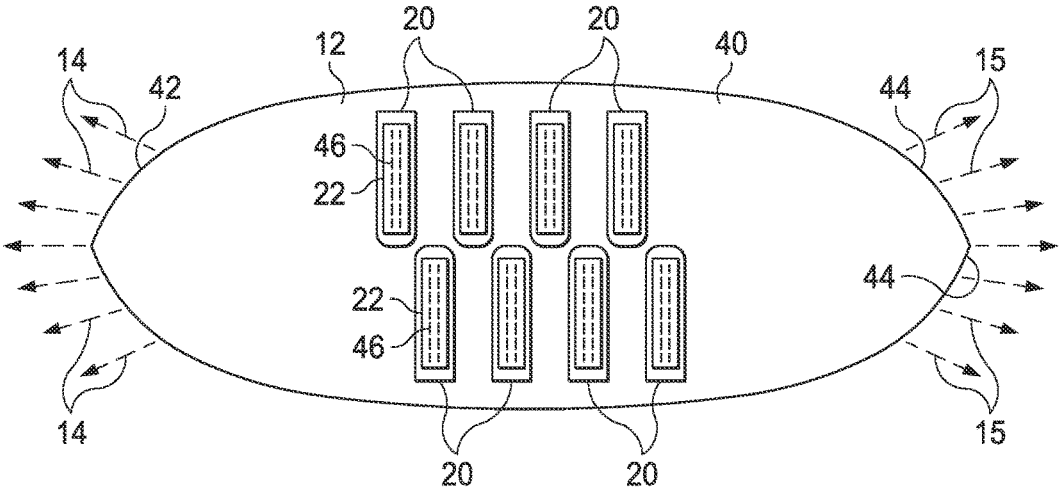

FIGS. 11 and 12 illustrate another example of an inkjet printer carriage 12, in which air curtains 14, 15 are formed around the front of the print zone with air scoops 48 at outboard parts 42, 44 of carriage 12. Referring to FIGS. 11 and 12, in this example each outboard part 42, 44 of carriage 12 is rounded to reduce drag as the carriage moves back and forth during printing. Each scoop 48 wraps around an outboard part 42, 44 to redirect the oncoming air down toward the print substrate around the front of print zone 16 such that each curtain 14, 15 partially surrounds the print zone. Each scoop 48 may be tapered from a deeper forward part 72 to a shallower rearward part 74, as shown in FIG. 11, to push the air down to help keep each air curtain as dense as possible around the carriage. Also in this example, the trailing part 52 of each scoop 48 is angled down and out to produce an air curtain 14, 15 with an air flow component 54 down across the print zone toward the print substrate (orthogonal to the direction the carriage moves) and an air flow component 56 upstream away from the carriage (parallel to the direction the carriage moves).

FIGS. 4-5, 9-10 and 11-12 show just three examples for the shape of scoop 48. Other suitable shapes are possible. For example, it may be desirable in some implementations to utilize a deeper scoop or a shallower scoop and/or with a higher angle or a lower angle trailing part to vary the volume, speed and/or direction of air flow through the scoop.

Figure 13:
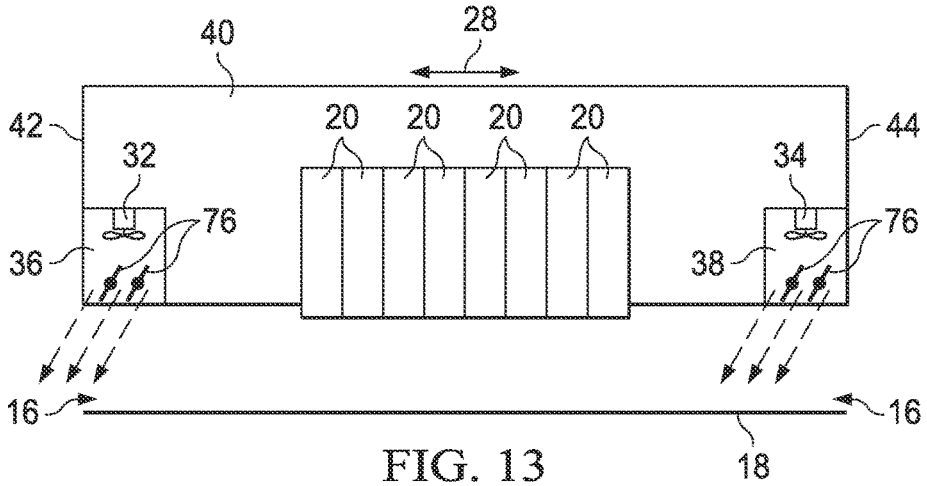
FIGS. 13 and 14 illustrate another example of a carriage configured to actively form air curtains to inhibit the flow of air through the print zone.
Figure 14:
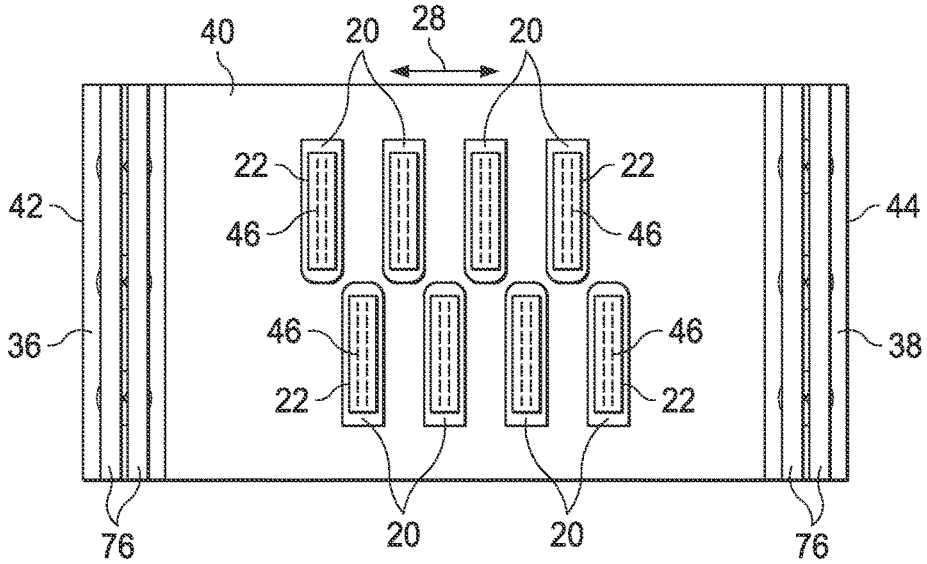

FIGS. 13 and 14 illustrate another example of an inkjet printer carriage 12, with variable direction air curtains 14, 15. Referring to FIGS. 13 and 14, in this example carriage 12 includes adjustable louvers 76 positioned in discharge ducts 64, 66 to vary the direction of flow in each air curtain 14, 15. Fans 32, 34 blow air through ducts 64, 66 past louvers 76. On the left side of carriage 12 in FIG. 13, louvers 76 in duct 64 are angled down and out to produce an air curtain 14 with an air flow component down across the print zone toward the print substrate and an air flow component outboard, away from the print zone. On the right side of carriage 12 in FIG. 13, louvers 76 in duct 66 are angled down and in to produce an air curtain 15 with an air flow component down across the print zone toward the print substrate and an air flow component inboard, toward the print zone. These are just two examples for the position of louvers 76. Louvers 76 may be adjustable throughout a full range of motion that includes completely blocking the flow of air from one or both ducts 64, 66, directing the air inboard, directing the air outboard, and/or directing the air straight down.

Figure 15:
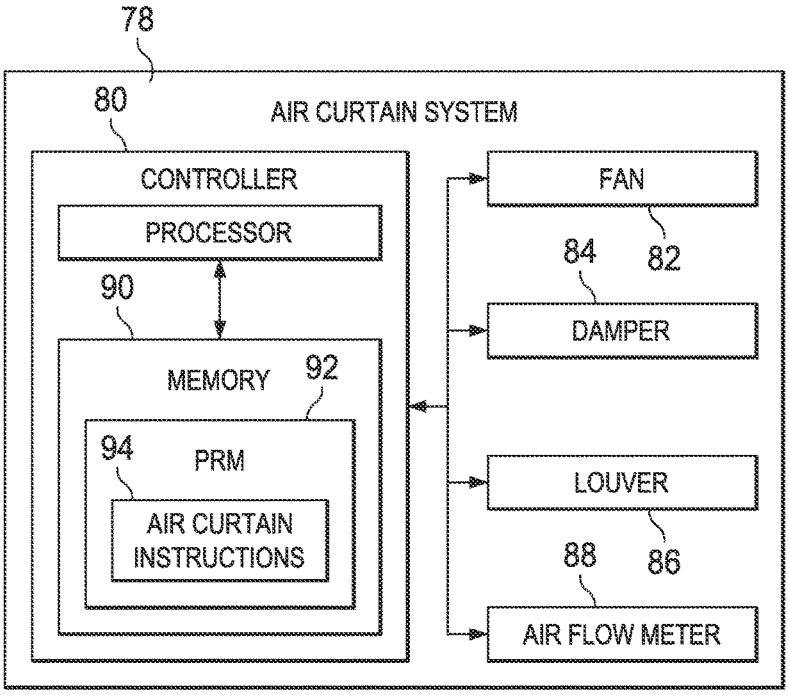
FIG. 15 is a block diagram illustrating one example of a system to form an air curtain to inhibit the flow of air through a print zone.

FIG. 15 is a block diagram illustrating a system 78 that can be used to form an air curtain to inhibit the flow of air through a print zone, such as air curtains 14, 15 in printer 10 shown in FIG. 1. Referring to FIG. 15, system 78 includes a controller 80 operatively connected to a fan 82, a damper 84, louver 86, and an air flow meter 88. Controller 80 represents the program instructions, processor(s) and associated memory(ies), and the electronic circuitry and components needed to control the operative elements of system 78. In particular, controller 80 includes a memory 90 having a processor readable medium (PRM) 92 with instructions 94 for controlling the functions of air curtain system 78, and a processor 96 to read and execute instructions 94.

Processor 96 represents any component or system capable of executing program instructions stored in memory 90, including air curtain instructions 94 on processor readable medium 92. Memory 20 represents one or more processor readable media and/or other memory units capable of storing program instructions. A processor readable medium is any non-transitory tangible medium that can embody, contain, store, or maintain instructions for use by a processor. Processor readable media include, for example, electronic, magnetic, optical, electromagnetic, or semiconductor media. More specific examples of suitable processor readable media include, for example, a hard drive, a random access memory (RAM), a read-only memory (ROM), memory cards and sticks and other portable storage devices.

Although only one controller 80, fan 82, damper 84, louver 86 and flow meter 88 are shown, each component represents one or much such components. For example, a single controller 80 could be used to control multiple fans 82, dampers 84, louvers 86 and flow meters 88. For another example, a single fan 82 might supply pressurized air to multiple ducts each with a damper 84, louvers 86 and/or a flow meter 88. Thus, other suitable configurations for system 78 are possible. Also, controller 80 may be an integral part of a printer controller 30 shown in FIG. 1. Alternatively, controller 80 may be separate from the printer controller.

Figure 16:
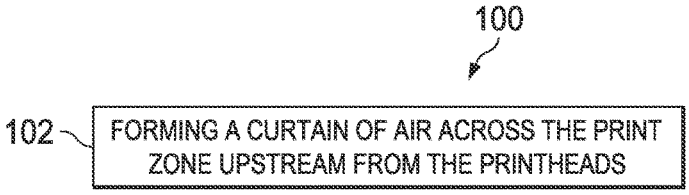
FIGS. 16-18 are flow diagrams illustrating examples of a method to inhibit air flow through a print zone between a print substrate and printheads on a carriage moving over the substrate.
Figure 17:
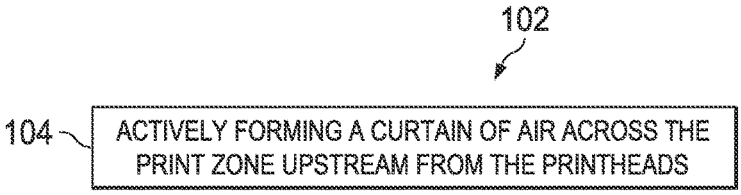
Figure 18:
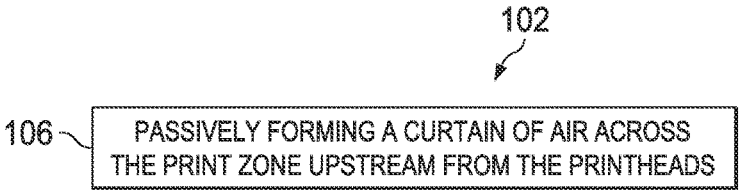

FIG. 16 is a flow diagram illustrating a method 100 to inhibit air flow through a print zone between a print substrate and a printhead on a carriage moving over the substrate. Referring to FIG. 16, method 100 includes forming a curtain of air across the print zone upstream from the printheads (step 102). In the example shown in FIG. 17, step 102 in method 100 includes actively forming the curtain of air (step 104), for example by ducting pressurized air to an upstream part of the carriage and down toward the print substrate. In the example shown in FIG. 18, step 102 in method 100 includes passively forming the curtain of air (step 106), for example by redirecting oncoming air at a leading part of the carriage down toward the print substrate.

FIG. 19 is a flow diagram illustrating one example of a method 110 to actively form an air curtain to inhibit the flow of air through a print zone between a print substrate and a printhead on a carriage moving over the substrate. Method 110 may be implemented, for example, with air curtain system 78 in FIG. 15. The method of FIG. 19 may be performed, for example, at the direction of controller 80 executing instructions 94 in system 78. Referring to FIG. 19, pressurized air from one fan 82 or multiple fans 82 is ducted to one or both of the leading and trailing outboard parts of the carriage and discharged toward the print substrate (steps 112 and 114). The flow of air to one or both of the leading and trailing outboard parts may be increased, decreased or stopped (step 116), for example by changing the position of a damper 84 or by changing the speed of a fan 82, or both changing the position of a damper 84 and changing the speed of a fan 82. The flow of air may be metered (step 118) and the flow adjusted based on the metering (step 120), for example by increasing, decreasing or stopping the flow in step 116. Also, the direction of the flow of air from one or both the leading and trailing outboard parts may be changed (step 122), for example by changing the position of a louver 86.

As noted at the beginning of this Description, the examples shown in the figures and described above illustrate but do not limit the invention. Other examples are possible. Therefore, the foregoing description should not be construed to limit the scope of the patent, which is defined in the following claims.

What is claimed is:

1. A carriage to move in a first direction and in a second direction opposite from the first direction to carry a printhead over a print substrate, the carriage comprising:

an inboard part to hold the printhead; and an outboard part comprising a surface to, when the carriage moves in the first direction, redirect an airflow having a component directed along the second direction to form an air curtain having a component directed toward the print substrate and extending along a leading end of the carriage to inhibit the flow of air under the carriage.

2. The carriage of claim 1, wherein the outboard part further comprises:

another surface to, when the carriage moves in the second direction, redirect an airflow having a component directed along the first direction to form an air current having a component directed toward the print substrate and extending along the leading edge of the carriage to inhibit the flow of air under the carriage.

3. The carriage of claim 1, wherein the outboard part further comprises:

a first scoop at a first end of the carriage, wherein the scoop comprises the surface, and the scoop comprises a trailing part angled down and out to produce an air flow component down toward the print substrate and an air flow component upstream away from the first end of the carriage.

4. The carriage of claim 3, wherein:

the scoop wraps around the first end of the carriage to redirect oncoming air down toward the print substrate in a curtain of air that partially surrounds a print zone under the carriage.

5. The carriage of claim 4, wherein the scoop is tapered from a deeper forward part to a shallower rearward part.

6. The carriage of claim 1, wherein the leading end extends along a direction transverse to the first direction.

7. The carriage of claim 1, wherein the outboard part comprises a duct having an outlet, wherein the outlet is oriented to discharge air toward the print substrate to form the air curtain.

8. A method comprising:

inhibiting air flow through a print zone between a print substrate and a printhead carried by a carriage in a first direction over the print substrate, wherein inhibiting the air flow comprises using a surface to redirect an airflow having a component directed along a second direction opposite to the first direction to form a curtain of air across a leading part of the carriage upstream from the printhead.

9. The method of claim 8, wherein forming the curtain of air comprises redirecting an airflow using a scoop comprising a trailing part angled down and the out to produce an airflow component down toward the print substrate and an airflow component upstream away from the leading part of the carriage.

10. The method of claim 8, wherein the inhibiting air flow comprises forming an air curtain having an elongated dimension that extends in a direction that is transverse to the first direction.

11. A system to inhibit the flow of air under a printhead carriage moving over a print substrate, the system comprising:

a fan;

a duct comprising an outlet, wherein the duct to receive air from the fan and the outlet being oriented to discharge the air toward the print substrate;

a damper in the duct; and a controller operatively connected to the fan and the damper, the controller including a processor and a processor readable medium having instructions thereon that when executed by the processor cause the controller to adjust one or both of the fan and the damper to increase the flow of air from the duct, to decrease the flow of air from the duct, or to stop the flow of air from the duct.

12. The system of claim 11, comprising a louver in the duct operatively connected to the controller and wherein the processor readable medium has instructions thereon that when executed by the processor causes the controller to adjust the louver to change the direction air is discharged from the duct.

13. The system of claim 12, comprising an air flow meter operatively connected to the duct and to the controller and wherein the processor readable medium has instructions thereon that when executed by the processor cause the controller to adjust one or more of the fan, the damper, and the louver based on signals from the flow meter.

14. The system of claim 11, wherein the outlet is positioned to discharge the air upstream from a print zone associated with the carriage.

* * * * *